United States Patent [19]

Eckley

[11] 4,212,455

[45] Jul. 15, 1980

[54] POWER SAW BLADE CHANGE ASSIST

[76] Inventor: James N. Eckley, 1752 N. Atherton St., State College, Pa. 16801

[21] Appl. No.: 964,683

[22] Filed: Nov. 29, 1978

[51] Int. Cl.[2] ..... B25B 1/08; B25B 1/10; B25B 1/20

[52] U.S. Cl. ..... 269/236; 269/246; 269/321 W

[58] Field of Search ..... 269/246, 249, 1–4, 269/95, 231, 236, 321 W; 248/469, 473; 83/701; 29/281.1

[56] References Cited

U.S. PATENT DOCUMENTS

| | | | |
|---|---|---|---|
| 1,255,773 | 2/1918 | Morse | 269/231 |
| 2,558,404 | 6/1951 | Watson | 269/246 |
| 4,083,624 | 4/1978 | Timmer | 269/249 |

*Primary Examiner*—Robert C. Watson

*Attorney, Agent, or Firm*—Wenderoth, Lind & Ponack

[57] ABSTRACT

A power saw circular blade change assist which has a horizontal base and a vertical holder extending upward from the base. A groove for receiving the saw blade is formed in the vertical holder and the base. There is a screw through one side of the vertical holder which extends into the groove and forces against a saw blade in the groove to hold it securely.

8 Claims, 7 Drawing Figures

POWER SAW BLADE CHANGE ASSIST

BACKGROUND OF THE INVENTION

The present invention relates to a device for securely holding a saw blade of a power saw while loosening or replacing the blade.

Usually, the saw blade of any power saw which has a circular blade, such as a portable power saw, table saw, or a radial arm saw is mounted onto a shaft connected to the saw motor by means of nuts or other tightening elements. When it is time to replace or change the saw blade, these tightening elements must be loosened before the blade can be removed from the shaft. A problem is created during the process of loosening the tightening element. Because the shaft is almost always free to rotate, attempting to rotate the tightening element and thus remove it from the shaft also causes the shaft to rotate, thereby making loosening of the tightening element very difficult. If the shaft can be prevented from rotating, however, the removal of the tightening element is greatly simplified.

One solution for stopping the rotation of the shaft is simply to stop the blade connected to the shaft from rotating. This, unfortunately, is usually accomplished by inserting a piece of wood or other sturdy material into the teeth of the saw blade in the direction of rotation of the blade and then holding the wood in a wedged position between the blade and the inside of the opening of the power tool surrounding the blade. This solution is not without its drawbacks. First of all, it is easy to damage the saw blade—especially carbide tipped blades—by jamming the wood into the teeth of the blade and, even more important, the method is dangerous because it can cause injury to the person changing the saw blade if his hand should slip away from the wood into the teeth of the blade during this process. Similar problems with the shaft turning arise when trying to replace the tightening element after the new blade is in position. In this situation, however, it is even more difficult to hold the blade stationary, because nothing can be wedged between the saw teeth and the opening. The saw teeth are directed in the direction opposite to the tightening motion, so the teeth will not grip into any wedging material as the blade rotates. As a consequence, at the present time there is really no adequate and safe method or means of holding the blade stationary while the nut or tightening device is being loosened or tightened.

Furthermore, once the tightening device is loosened, the blade then must be removed from the shaft. The same problem here arises with regard to the sharp teeth of the blade. Since the blade must be grabbed by hand to remove it from the shaft, the person removing the blade must be especially careful not to injure himself on the teeth of the blade while he is holding it and removing it from the shaft.

SUMMARY OF THE INVENTION

It is, therefore, an object of the present invention to provide a saw blade change assist which can be safely used to securely, stationarily hold a saw blade while the nut or similar tightening element holding the blade onto the motor shaft is being loosened or tightened, without anyone having to specifically hold the saw blade or insert a wedge between the saw blade and the surrounding tool to prevent the blade from turning.

Furthermore, it is also an object of the present invention to provide a device which can be used to safely remove a saw blade from the shaft once the tightening elements are removed without requiring the person removing the blade to actually grab hold of the blade.

These objects are achieved in the present invention by utilizing a device which has a broad horizontal base portion and a vertical holder extending upward from this base portion. The vertical holder and the base portion have a curvilinear groove therein opened on one side which will receive the circular form of the edge of the saw blade. A threaded screw is fitted through one side of the vertical holder on one side of the groove, and by rotating the screw, the screw will press against the saw blade in the groove and hold it securely. The base support member safely supports the weight of the blade so that holding the blade by hand is unnecessary.

BRIEF DESCRIPTION OF THE DRAWINGS

The above-mentioned and further objects of the present invention will be more readily apparent from the following description read with the following drawings, in which.

DETAILED DESCRIPTION OF THE INVENTION

Figure 2:
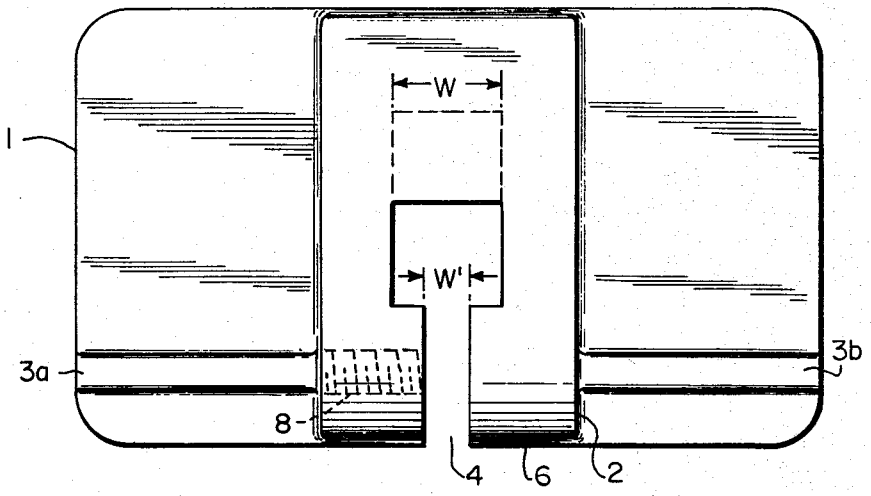
FIG. 2 is a top view of the first embodiment of the invention (without the saw blade)
Figure 3:
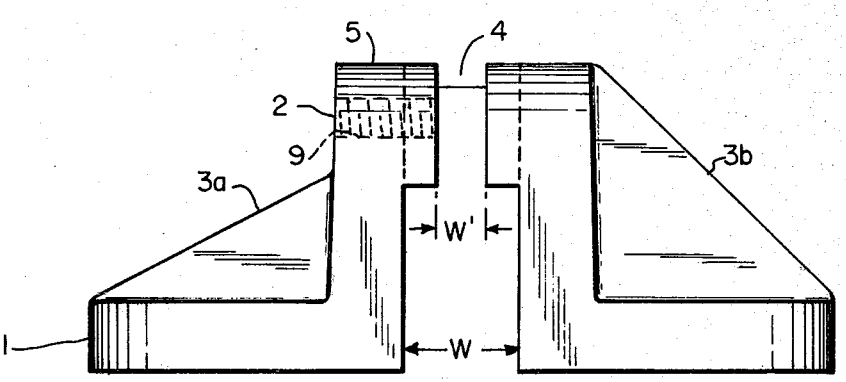
FIG. 3 is an end view of the first embodiment of the invention in the direction of arrow A in FIG. 1 (without the saw blade)
Figure 1:
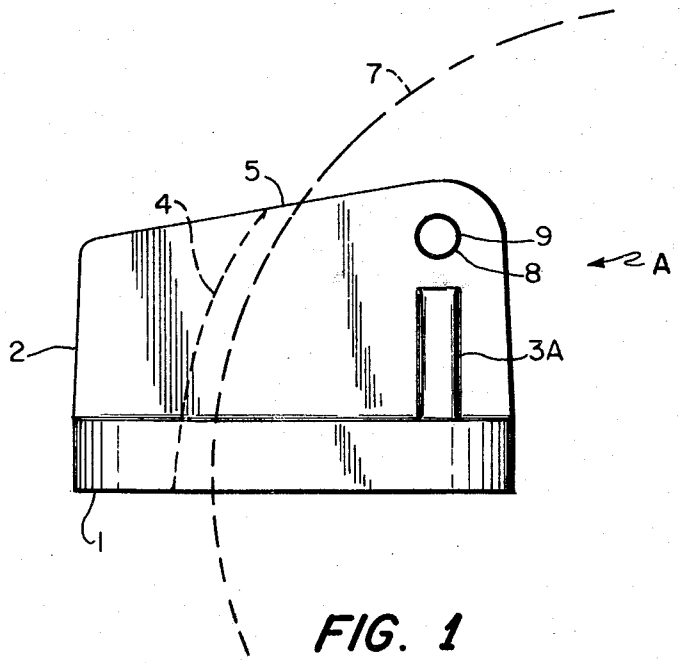
FIG. 1 is a side view of the first embodiment of the invention with a saw blade inserted thereinto.

The saw blade change assist of the present invention has a horizontal base portion 1 which provides a stable base on a flat surface, such as the table surface of a power saw. Extending upward from the base portion 1 is a vertical holder 2. This vertical holder has a groove 4 therein; the groove 4 passes through the top 5 and front 6 surfaces of the holder 2 and extends downward through the base portion 1. A slight curved or arched form is preferably given to the groove 4 so that a circular saw blade 7 will easily fit thereinto (FIG. 1). To hold the saw blade 7 securely in the groove 4, a threaded hole 8 is formed through at least one side of the vertical holder 2 and extends from the outside of the holder to the groove 4. A set screw 9 is threaded into the hole 8 and is designed to be tightened toward the groove 4 so that it will contact the blade 7 in the groove 4 and hold it securely within the groove. While it is envisioned that a threaded set screw may be used to hold the saw blade in the groove, it is recognized that many other fastening devices may also be used and still be within the scope of this invention. For example, a pivotable cam-type lever can be mounted on one side of the vertical holder and pivoted against the blade to hold it securely, or a screw with a handle on the outside may be devised so that a screw driver is not necessary. Also, an adjustable, swivel-type head 15 may be provided on the end of the screw in the groove which will conform to an angle of the blade in the groove.

As additional means for supporting the vertical holder 2, braces 3*a* and 3*b* are provided on both sides of the holder. These braces extend upward from the base portion and brace against the vertical holder and help to retain the vertical holder upright.

As shown in FIGS. 2–7, the groove 4 does not have a constant width W. Instead bosses 10, 10 are formed within the groove at the position where the screw or cam forces against the saw blade so that the groove will be width W which is wider at the rear portion than the width W′ at the front of the groove where the blade is held. By this arrangement, the "set" of teeth on the blade will not contact the inside of the groove when the blade is held in the groove. This will help to prevent the set from being damaged.

Figure 6:
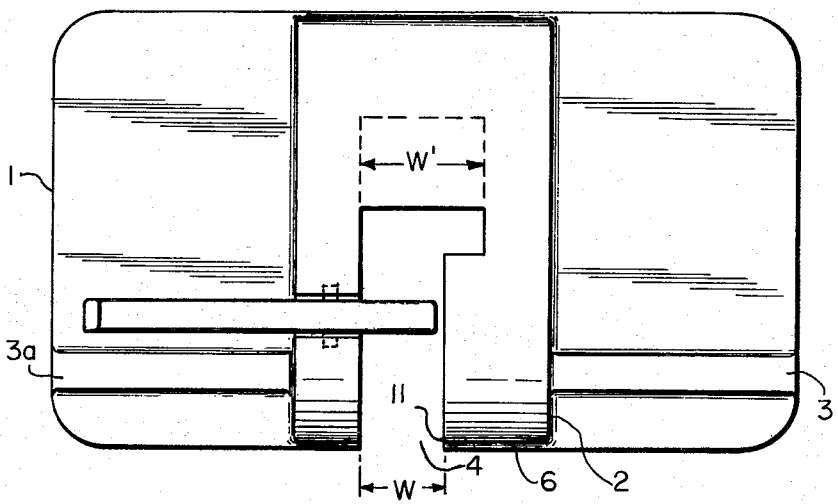
FIG. 6 is a top view of a third embodiment of the invention.
Figure 7:
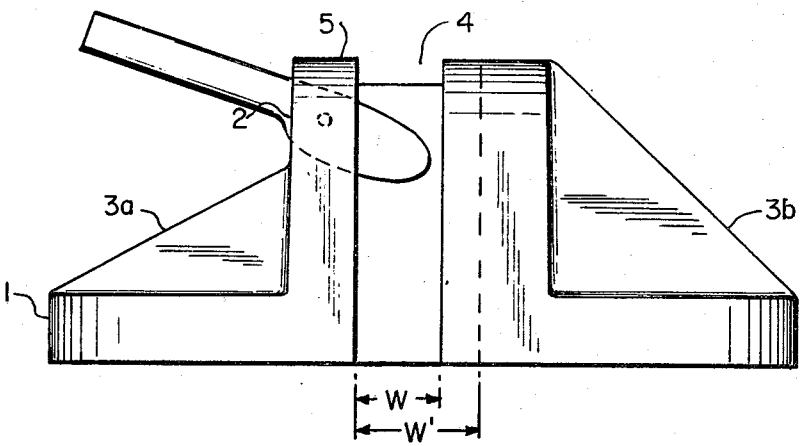
FIG. 7 is an end view of the third embodiment.
Figure 4:
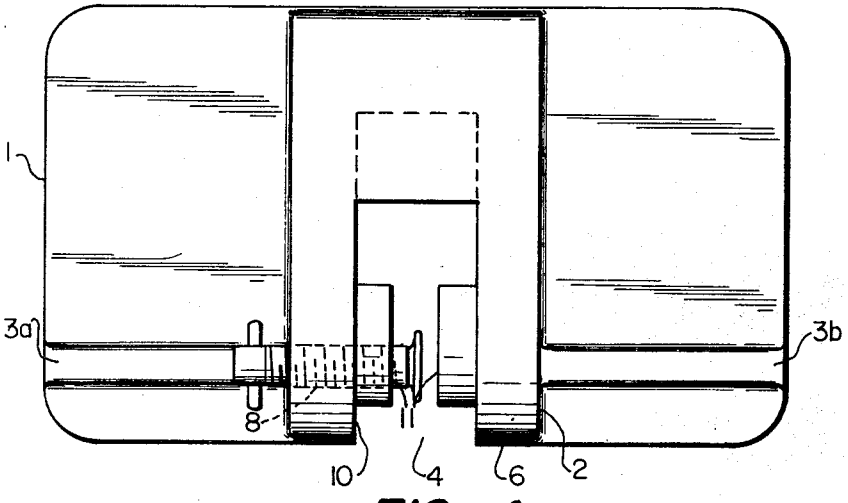
FIG. 4 is a top view of a second embodiment of the invention.
Figure 5:
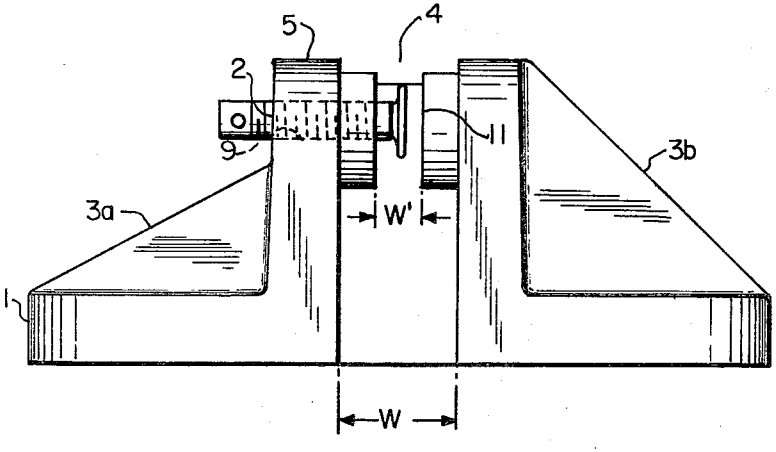
FIG. 5 is an end view of the second embodiment.

While FIGS. 2 to 5 show two bosses 10, 10 within the groove 4, the spacing of the set of teeth within the groove 4 can also be achieved by providing only one boss 11, as shown in FIGS. 6 and 7. When the blade is secured within the front width W′, the teeth will still be spaced from the sidewalls of the groove at the rear thereof.

Again, the main consideration in any of these structures is to provide a groove that will allow the insertion of the saw blade thereinto and at the same time provide adequate spacing around the teeth of the inserted blade to prevent them from being damaged, while securely holding the blade in the groove by means of the fastening device. It is recognized that other modifications of this structure are possible, and it is not the Applicant's intention to limit this invention to only those specific embodiments presented herein.

Generally, the change assist is formed as a single unit. The base portion 1, the vertical holder 2, and the side braces 3*a* and 3*b* are preferably intergally formed of a metal, such as aluminum, by a casting technique. Again, other metals and casting or forming procedures are recognized as being applicable to the formation of this structure. For example, the assist may also be formed of rigid plastic by an injection-molding method.

To use the saw blade change assist of this invention to change a saw blade on, for example, a table saw, the base portion 1 is set on the tabletop and is slid forward so that the saw blade 7 fits into the groove 4. Once inside the groove, the set screw 9 is tightened against the blade. In this manner, the blade is securely held in the groove.

Because the base portion and vertical holder are of sufficient size to hold the weight of the saw blade 7 and prevent the blade from turning, it is not necessary to physically hold onto either the change assist or the blade during either tightening or loosening. Then, both hands of the saw operator are free to manipulate the tools necessary to tighten or loosen the blade from its motor mounting. Furthermore, after the tightening devices are removed, the assist will continue to hold the blade; and to remove the blade, all that is necessary is to lift the change assist while the blade is still attached thereto. Since the blade is never grabbed by hand, the safety hazards usually equated with changing a saw blade are greatly reduced.

It is clearly recognized that certain features of the change assist, especially size, will necessarily vary with the type of saw blade being changed. A very large or heavy blade will, of course, require a larger and heavier assist with a groove of appropriate width. Such modifications are intended to be within the scope of the invention of this application.

What is claimed is:

1. A device for use in changing a power saw blade, said device comprising:

a horizontal base portion for providing a stable base;

a vertical holder on top of said horizontal base portion, said vertical holder having a vertical groove therethrough extending downward through said horizontal base portion, said groove having a curved rear portion and being large enough for receiving the saw blade therein, said groove further having a non-constant width, said curved rear portion of said groove having a first width large enough for accomodating the set of the teeth of the saw blade, and said groove having a front portion having a second width less than said first width; and a fastening means through said vertical holder and moveable into said front portion of said groove for holding the saw blade in said groove.

2. A device as claimed in claim 1, further comprising:

bracing means on opposite sides of said vertical holder engaging said holder and said base for bracing said vertical holder against sideways movement.

3. A device as claimed in claim 2, wherein said horizontal base, said vertical holder, and said bracing means are integrally formed as one assist piece.

4. A device as claimed in claim 3, wherein said assist piece is comprised of aluminum.

5. A device as claimed in claim 3, wherein said assist piece is comprised of injection-molded plastic.

6. A device as claimed in claim 1, wherein said fastening means is a set screw threaded through said vertical holder into said groove.

7. A device as claimed in claim 6 wherein said set screw has a swivel head on the end thereof extending into said groove.

8. A device as claimed in claim 1, wherein said fastening means is a cam lever pivotally mounted on said vertical holder and movable into said groove.

* * * * *